United States Patent [19]

Sase

[11] 4,028,982

[45] June 14, 1977

[54] PIPE ORGAN

[75] Inventor: Hisashi Sase, Chiba, Japan

[73] Assignees: Toho Plastics Co., Ltd.; Mitsubishi Pencil Co., Ltd., both of Tokyo, Japan

[22] Filed: May 6, 1976

[21] Appl. No.: 683,755

[30] Foreign Application Priority Data

June 11, 1975 Japan ..... 50-70583

[52] U.S. Cl. ..... 84/331; 84/335

[51] Int. Cl.[2] ..... G10B 3/00

[58] Field of Search ..... 84/330–350, 84/359, 361, 372

[56] References Cited

UNITED STATES PATENTS

| | | | |
|---|---|---|---|
| 339,237 | 4/1886 | Wales | 84/331 |
| 1,742,121 | 12/1929 | Bawtree | 84/349 |

FOREIGN PATENTS OR APPLICATIONS

| | | | |
|---|---|---|---|
| 1,013,150 | 8/1957 | Germany | 84/331 |
| 197,403 | 5/1923 | United Kingdom | 84/339 |

*Primary Examiner*—Lawrence R. Franklin
*Attorney, Agent, or Firm*—Russell & Nields

[57] ABSTRACT

This invention relates to pipe organs using tracker action and more particularly, to an improved such pipe organ having a separate wind-chest and sound-board fixed so that the air efflux from the valves of the wind-chest flows through flexible pipes and is delivered to the pipes supported on the sound-board.

1 Claim, 3 Drawing Figures

PIPE ORGAN

BRIEF SUMMARY OF THE INVENTION

In accordance with the invention, a pipe organ using tracker action is made so that the flue pipes can be arranged at will and also the air pressure and the quantity of air to each pipe can be freely changed. The essential point is that the wind-chest and the sound-board are constructed separately, and the air efflux flowing from the valves of the wind-chest is delivered to the corresponding vertically arranged flue pipes on the sound-board by means of flexible pipes.

DESCRIPTION OF THE PREFERRED EMBODIMENT

Figure 1:
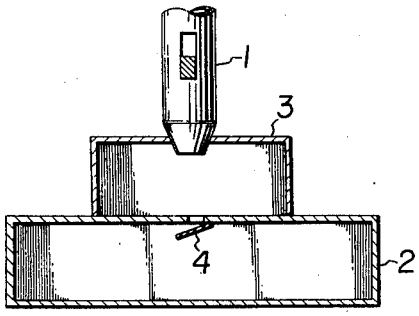
Figure 2:
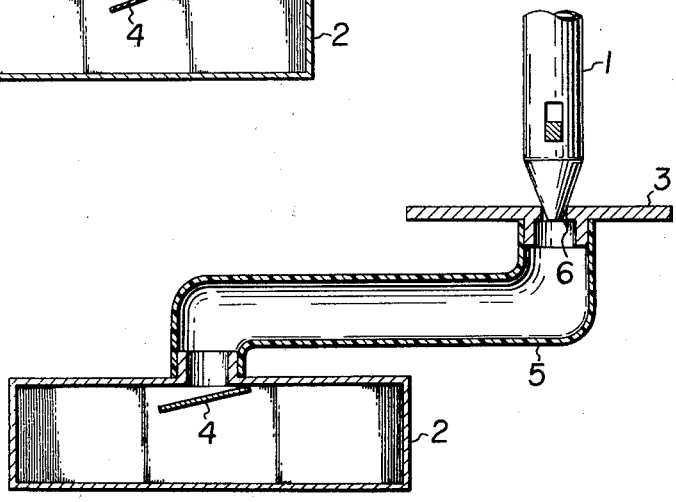
Figure 3:
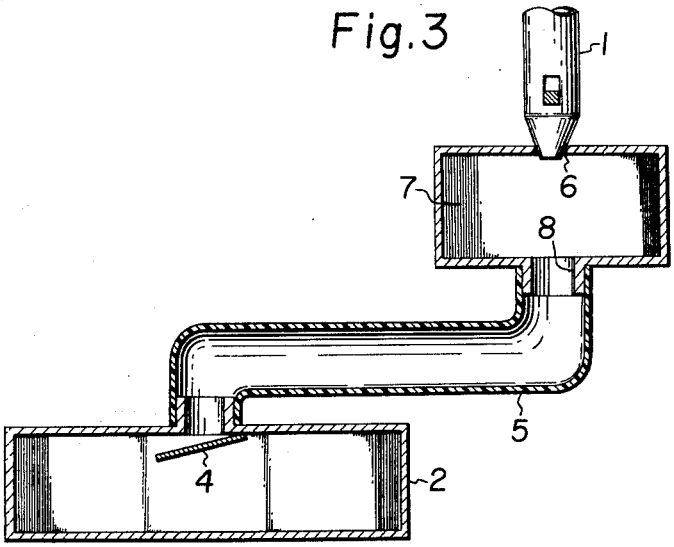

The invention may best be understood from the following detailed description thereof, having reference to the accompanying drawing, in which:

FIG. 1 is a side view, partly in section, of a wind-chest, sound-board and flue pipe of a traditional pipe organ; FIG. 2 is a view, similar to that of FIG. 1, showing one embodiment of the invention; and FIG. 3 is a view, similar to that of FIG. 1, showing another embodiment of the invention.

Referring to the drawing, and first to FIG. 1 thereof, therein is shown a conventional pipe organ wherein an accumulation of numerous sound-boards 3 each of which supports one or more pipes 1 is built up on wind-chest 2 in which air is stored to cause the pipes 1 to sound. A number of valves 4 equal to the number of sound-boards 3 are installed on the upper part of the wind-chest 2. By opening these valves 4 air is delivered to pipes 1 and thus sound is produced. Valve 4 is opened by pressing the key on the key board connected to valve 4. Three types of devices are known for causing connected movement of these keys and valves 4: 1) tracker action that pulls valve 4 with a wire, 2) pneumatic action that opens and closes valves 4 utilizing air pressure, and 3) electromagnetic action using electromagnetic valves.

Of these, the tracker action is used in many old pipe organs of the Baroque type, or portable organ, but such cases had the defect that it was not possible to arrange the pipes 1 in any desired formation because the arrangement of the pipes 1 was governed by the arrangement of the keys owing to the mechanical connection between the keys and the valves 4.

This invention provides an improved organ pipe that is simple in construction, efficient and economical to manufacture.

This invention, while using tracker action, makes it possible freely to rearrange the pipes 1 and also make it possible to change the quantity of air and air pressure to each pipe at will.

The structure of the present invention will now be explained by concrete examples.

As shown in figures 2 and 3, the wind-chest 2 that stores the air for causing pipes 1 to sound and each sound-board 3 which suports one or more pipes 1 are constructed separately. Each valve 4, that mechanically opens and closes by mechanically connected movement with the corresponding key of the keyboard, is installed on the upper part of the wind-chest 2. The air efflux that flows from the wind-chest 2 when this valve 4 is opened is supplied to pipe 1, which is supported on the sound-board 3, by way of flexible pipe 5 of soft vinylchloride or other material, and pipe 1 is caused to sound.

When only one pipe 1 is supported on one sound-board 3, the flexible pipe 5 is connected to hole 6 which has been formed in sound-board 3 for the purpose of supporting the pipe 1 of sound-board 3 (see FIG. 2). When, together with supporting several pipes 1 upon one sound board 3, a chamber 7 is formed on the lower part of the sound-board 3 and a slider (not shown) is fixed within chamber 7 and one or several pipes 1 are caused to sound simultaneously by the sliding action of the slider, then as shown in FIG. 3 hole 8 is formed in the lower part of chamber 7, and one end of the flexible pipe 5 is connected to this hole 8.

Accordingly, in this invention the relative position of the wind-chest and the sound-board which supports the pipes becomes free, and also the relative position of the keys of the keyboard and the pipes becomes free. Therefore, pipes of every size and shape, from the long fat low-sounding pipes to the short thin high-sounding pipes can be arranged in symmetrical or other optional shapes. Moreover, there are superior effects, such as being able freely to determine the quantity of air and air pressure delivered to each pipe by changing the length and the inner diameter of the flexible pipe.

Having thus described the principles of the invention, together with several illustrative embodiments thereof, it is to be understood that, although specific terms are employed, they are used in a generic and descriptive sense and not for purposes of limitation, the scope of the invention being set forth in the following claim.

I claim

1. A pipe organ comprising, in combination, a wind-chest, a sound-board formed separately from said wind-chest, at least one pipe supported on said sound-board, said wind-chest having at least one valve adapted to permit air efflux to flow out from said wind-chest, each of said valves having associated therewith a flexible tube adapted to deliver said air efflux to said pipe.

* * * * *